United States Patent [19]

Apel

[11] Patent Number: 4,875,906

[45] Date of Patent: Oct. 24, 1989

[54] PARTIAL OXIDATION OF LOW HEATING VALUE HAZARDOUS WASTE PETROLEUM PRODUCTS

[75] Inventor: Howard L. Apel, Ontario, Calif.

[73] Assignee: Texaco Inc., White Plains, N.Y.

[21] Appl. No.: 269,326

[22] Filed: Nov. 10, 1988

[51] Int. Cl.[4] ..... C10J 3/46

[52] U.S. Cl. ..... 48/197 R; 48/202; 48/206; 48/DIG. 7; 252/373

[58] Field of Search ..... 48/197 R, 200, 201, 48/202, 206, 209, DIG. 7; 252/373; 44/51

[56] References Cited

U.S. PATENT DOCUMENTS

| | | | |
|---|---|---|---|
| 3,620,698 | 11/1971 | Schlinger et al. | 48/206 |
| 3,996,026 | 12/1976 | Cole | 48/197 R |
| 4,069,022 | 1/1978 | Metzger | 44/51 |
| 4,104,035 | 8/1978 | Cole et al. | 44/51 |
| 4,166,802 | 9/1979 | Slater et al. | 252/373 |
| 4,529,408 | 7/1985 | Yan | 44/51 |
| 4,610,695 | 9/1986 | Crespin et al. | 44/51 |
| 4,623,359 | 11/1986 | Yaghmaie et al. | 44/51 |
| 4,749,381 | 6/1988 | Yaghmaie et al. | 44/51 |
| 4,762,527 | 8/1988 | Beshore et al. | 44/51 |

*Primary Examiner*—Peter Kratz

*Attorney, Agent, or Firm*—Robert A. Kulason; James J. O'Loughlin; Albert Brent

[57] ABSTRACT

Low heating value liquid hydrocarbonaceous and/or solid carbonaceous hazardous waste materials from the production, refining and marketing of petroleum products are destroyed without contaminating the environment while simultaneously gaseous mixtures comprising $H_2+CO$ i.e. synthesis gas, reducing gas, or fuel gas are produced. From about 0.3 to 2.0 wt. % of an anionic surface active dispersant and water (if needed) are mixed with the hazardous waste material to produce a first aqueous mixture. A comminuted solid carbonaceous fuel i.e. coal, petroleum coke is mixed with water and from about 0.02 to 1.00 wt. % of the dispersant to produce a second stable pumpable aqueous slurry. The first and second aqueous slurries are mixed together to produce a stable pumpable final blend aqueous slurry which is reacted in a partial oxidation gas generator as the feedstock. It was unexpectedly found that to achieve slurries with satisfactory rheological properties from mixtures of hazardous waste material and coal or coke slurries, it was necessary to add the dispersant to the coal/coke slurry as well as to the slurry of hazardous waste material before combining the two aqueous mixtures together.

11 Claims, No Drawings

PARTIAL OXIDATION OF LOW HEATING VALUE HAZARDOUS WASTE PETROLEUM PRODUCTS

FIELD OF THE INVENTION

This invention relates to the partial oxidation of low heating value hazardous waste materials from the production, refining and marketing of petroleum products.

The disposal of low heating value e.g. less than about 5000 btu/lb liquid hydrocarbonaceous and/or solid carbonaceous hazardous waste materials from the production, refining, and marketing of petroleum products without polluting the environment raises a serious problem. Burning and incineration causes air-pollution from noxious gases and soot, while dumping causes pollution of underground water streams.

By the well known partial oxidation process, the regular liquid and solid carbonaceous fuels having a high calorific value may be readily converted into gaseous mixtures comprising hydrogen and carbon oxides. However, materials having a low calorific value cannot be directly used as fuel for a partial oxidation reactor.

Considerably different feedstocks, such as sewage and garbage, have been burned by partial oxidation in coassigned U.S. Pat. Nos. 3,671,209 and 3,687,646, which are incorporated herein by reference. While surface active agents were used with sub-bituminous coal and lignite in coassigned U.S. Pat. No. 4,304,572, which is incorporated herein by reference, stable pumpable slurries of the hazardous waste materials from the production, refining and marketing of petroleum products in admixture with high calorific solid carbonaceous fuels could not be produced having a high solids content i.e. greater than 50 wt. % prior to applicant's process. Applicant's process provides a method for disposing of these noxious materials without polluting the environment; and this is a substantial improvement in the art . Further, it provides a method of using these low cost waste materials having low calorific values as feedstock to the partial oxidation reactor for production of synthesis gas, reducing gas, or fuel gas.

A preferred way to introduce a fuel feedstock into a partial oxidation gas generator is by means of a pumpable aqueous slurry and an annular type fuel burner. The efficiency of the partial oxidation process is greatly improved by increasing the solids content of the fuel slurry while keeping the viscosity low enough to be pumpable. By the subject process greater amounts of low heating value liquid hydrocarbonaceous and/or solid carbonaceous hazardous waste petroleum materials may be mixed with slurries of coal and/or petroleum coke. Pumpable slurries having a solids content in the range of about 50 to 70 wt. % are thereby produced which are convenient for transporting these wastes into a partial oxidation gasifier with an upgraded heating value that is necessary for the autogenous partial oxidation process.

SUMMARY OF THE INVENTION

This is a partial oxidation process for disposing of low heating value liquid hydrocarbonaceous and/or solid carbonaceous hazardous waste materials from the production, refining and marketing of petroleum products, and the production of gaseous mixtures comprising $H_2+CO$ comprising the steps of:

(1) mixing together low heating value liquid hydrocarbonaceous and/or solid carbonaceous hazardous waste materials from the production, refining and marketing of petroleum products with additional water when needed and about 0.3 to 2.0wt. % of an anionic surface active agent to produce a stable pumpable aqueous mixture having a solids content of up to about 70 wt. %; and having a heat content of up to about 5000 btu/lb;

(2) mixing together a solid carbonaceous fuel selected from the group consisting of coal, petroleum coke, asphalt, tar sands, and mixtures thereof with water and from about 0.02 to 1.00 wt. % of an anionic surface active agent to produce a stable pumpable aqueous slurry having a solids content in the range of about 50 to 70 wt. %, and having a heat content of about 5000 btu/lb and above;

(3) mixing together from about 4 to 19 parts by weight of the mixture from (2) per part by weight of the mixture from (1) to provide a stable pumpable final blend aqueous slurry having a solids content in the range of about 50 to 70 wt. % and a heat content of above about 5000 btu/lb; and, (4) reacting the final blend aqueous slurry from (3) in a free-flow unobstructed refractory lined partial oxidation reaction zone with a free-oxygen containing gas and in a reducing atmosphere at a temperature in the range of about 1900° to 300020 F. and a pressure in the range of about 2 to 250 atmosphere to produce a hot raw effluent gas stream comprising $H_2+CO$.

DISCLOSURE OF THE INVENTION The present invention involves an improved continuous process for disposing of hazardous liquid hydrocarbonaceous and/or solid carbonaceous waste materials having a low heat content from the production, refining and marketing of petroleum products without polluting the nations environment. Simultaneously, valuable by-products are produced in the form of synthesis gas, fuel gas or reducing gas. There is a significant financial and human health incentive to develop beneficial ways to utilize and/or to get rid of hazardous wastes. By the subject invention, low heating value-liquids and solid carbonaceous hazardous wastes are reduced or destroyed by partial oxidation gasification.

The expression low heating value hazardous liquid hydrocarbonaceous and/or hazardous solid carbonaceous waste materials from the production, refining and marketing of petroleum products as used herein includes such petroleum base materials as tank and pond bottoms, separator sludge, air flotation solids, by-product streams, and off specification and contaminated products. The term "and/or" is intended to mean either liquid hydrocarbonaceous waste materials, solid carbonaceous waste materials, or mixtures thereof.

It was found that these oily-solid wastes did not satisfactorily mix or combine with comminuted or slurried coal and/or petroleum coke. In the subject invention, the low heating value liquid hydrocarbonaceous and/or solid carbonacoeus hazardous waste materials from the production, refining and marketing of petroleum products are first mixed together with about 0.3 to 2.0 wt. % of an anionic surface active agent and additional water when necessary to produce a stable pumpable aqueous mixture having a solids content of up to about 70 wt. %, such as from about 40 to 70 wt. %, and having a heat content of up to about 5000 btu/lb, such as from about 500 to 5,000 btu/lb.

Anionic surface active agents comprising salts of an organic sulfonic acid were found to be particularly suitable surface active agents for preparing said stable pumpable aqueous hazardous liquid hydrocarbonaceous and/or solid carbonaceous waste mixtures. Examples of such surfactants are the calcium, sodium and ammonium salts of organic sulfonic acids such as liquid sulfonic acid i.e. ammonium lignosulfonate, and 2,6-dihydroxy naphthalene sulfonic acid. The surfactant should be present in the aqueous hazardous waste mixture in an amount of about 0.3 to 2.0 wt. % (basis wt. % aqueous hazardous waste mixture in the final blend).

A comminuted solid carbonaceous fuel selected from the group consisting of coal, petroleum coke, asphalt, tar sands, and mixtures thereof is mixed with water and from about 0.02 to 1.00 wt. % of an anionic surface active agent to produce a stable pumpable aqueous slurry having a solids content in the range of about 50 to 70 wt. %, and having a heat content of about 5000 btu/lb and above, such as about 5,000 to 12,000 btu/lb. The composition and particle size of the solid carbonaceous fuel differ substantially from those of the solid carbonaceous hazardous waste materials. The coal is selected from the group consisting of anthracite, bituminous, subbituminous, lignite, and mixtures thereof. The anionic surface active agent used in the preparation of said aqueous slurry of solid carbonaceous fuel has been described previously in connection with the pumpable aqueous mixtures of liquid hydrocarbonaceous and/or solid carbonaceous hazardous waste materials.

A stable aqueous final blend slurry is produced comprising about 4 to 19 parts by weight of said previously described aqueous slurry of comminuted solid carbonaceous fuel for each part by weight of said previously described aqueous hazardous waste mixtures. The stable pumpable final blend slurry has a viscosity in the range of about 100 to 1000 centipoise, as determined by a Stormer viscosimeter. The heat content of the aqueous final blend slurry will be determined by its composition; and, it may be for example above about 5000 btu/lb.

It was found that results were unsatisfactory when the surfactant was added only to the aqueous slurry of solid carbonaceous fuel, or only to the aqueous mixtures of waste material before attempting to mix the two aqueous mixtures together It was unexpectedly found that to achieve success in obtaining suitable solids loading with satisfactory rheological properties, it was necessary to add the dispersant to both aqueous slurries (in the critical concentrations specified) before combining the two aqueous mixtures together. In such case, the dispersant acted to reduce chemical bonding in each aqueous mixture i.e. coal slurry and waste mixture. This enabled the two materials, now in a more fluid state, to readily mix or blend together with aid of stirring or circulation. The subject process allows a greater amount of hazardous waste material to be blended with a coal and/or coke slurry. The overall economics of the process are thereby substantially improved. More dispersant was required in the stable pumpable aqueous mixture of waste material than in the stable pumpable aqueous slurry of solid carbonaceous fuel to produce the stable pumpable mixture of the two aqueous slurries. In order to maintain stability i.e. little or no separation of solids over a period of 24 hours, caution is necessary not to overdose with the dispersant.

Prior to slurrying, the solid carbonaceous fuels and, if necessary, the solid carbonaceous hazardous waste materials are preferably ground to a particle size so that substantially all i.e. 100% of the material passes through an ASTM E 11-87 Sieve Designation Standard 1.4 mm (Alternative No. 14) and at least 80% passes through an ASTM E 11-87 Sieve Designation Standard 425 μm (Alternative No. 40).

The final blend aqueous slurry is introduced as the fuel mixture into the reaction zone of a vertical refractory-lined, unobstructed, free-flow, down-flowing noncatalytic, partial oxidation gas generator by way of a burner. Simultaneously, a stream of free-oxygen containing gas is introduced into the gas generator. Single and double annulus type burners for introducing the feedstreams into the partial oxidation gas generator are shown in coassigned U.S. Pat. Nos. 3,528,930 and 3,847,564, which are incorporated herein by reference. Typical partial oxidation gas generating processes are shown in coassigned U.S. Pat. Nos. 4,251,228 and 4,446,810, which are incorporated herein by reference.

The partial oxidation reaction takes place in the reaction zone of the gas generator in a reducing atmosphere at a temperature in the range of about 1900° to 3000° F. and a pressure in the range of about 2 to 250 atmosphere, say 10 to 100 atmospheres. The atoms of free-oxygen plus atoms of organically combined oxygen in the solid carbonaceous fuel per atom of carbon in the solid carbonacoeus fuel (O/C. atomic ratio) may be in the range of 0.5 to 1.5. With free-oxygen containing gas in the reaction zone the broad range of said O/C. atomic ratio may be about 0.3 to 1.4, such as about 0.7 to 1.1. The free-oxygen is intended to include air, oxygen-enriched air i.e., greater than 21 mole % oxygen, and substantially pure oxygen, i.e. greater than 95 mole % oxygen, (the remainder comprising N2 and rare gases). The weight ratio $H_2O$/liquid hydrocarbonaceous and/or solid carbonaceous fuel in the reaction zone is in the range of about 0.03 to 1.0.

The raw product gas leaving the reaction zone may have the following composition in mole percent: H2 8 to 60, CO 8 to 70, $CO_2$ 1 to 20, $H_2O$ 1 to 40, $CH_4$ nil to 30, $H_2S+COS$ nil to 5.0, $N_2$ nil to 85 and A nil to 2.0. About 90 to 98 wt. % of the carbon in the original solid carbonaceous fuel is converted into carbon oxides e.g. $CO+CO_2$.

The following examples are submitted for illustrative purposes only and it should not be construed that the invention is restricted thereto.

EXAMPLE 1

Unsatisfactory mixing occurred when oily whole waste comprising an aqueous slurry of heavy liquid hydrocarbonaceous and solid carbonaceous fuel containing no additive was added directly to an aqueous slurry of Pittsburgh No. 8 coal containing no additive. A soft solid unpumpable mass which was difficult to liquify formed.

The materials tested were as follows: Pittsburgh No. 8 aqueous slurry had a solids content of 62.0 wt. %, a heat content of coal (dry basis) of 14,200 btu/lb, a particle size in the range of about 1 to 1000 microns, and a Stormer viscosity of about 620 centipoise. The whole waste aqueous slurry had a solids-oil content of 33.6 wt. %, and a heat content of about 4,570 btu/lb. The final blend stable pumpable aqueous slurry comprised 8.5 wt. % of whole waste aqueous slurry, and 91.5 wt. % of coal slurry.

EXAMPLE 2

The final blend of Example 1 remained unpumpable even though ammonium lignosulfonate in the amount of about 0.5 wt. % (basis wt. of whole waste slurry) was added to the whole waste aqueous slurry prior to mixing said material with the Pittsburgh No. 8 aqueous coal slurry. A final blend slurry of 59.8 wt. % solids having a Stormer viscosity of 426 centipoise and a calorific value of 8,480 btu/lb was obtained. However, at constant shearing, this slurry became undesirably viscous and unpumpable.

EXAMPLE 3

An undesirable final blend slurry was obtained when dry round Pittsburgh No. 8 coal having a particle size of about 1 micron to 1000 microns was added in small increments and stirred with an aqueous whole waste slurry containing 0.5 wt. % of ammonium lignosulfonate. At low concentrations, the coal seemed to mix satisfactorily while surface wetting appeared to be some problem. As the concentration increased, the coal did not disperse desirably. The slurry took on a gel like appearance with small lumps of coal. The viscosity could not be reliably determined due to slippage. This slurry was very oily, most likely due to the higher concentration of whole waste. The final blend slurry had a solids content of 54.2 wt. % and comprised 67.5 wt. % whole waste slurry with 0.5 wt. % of additive, and 32.5 wt. % Pittsburgh No. 8 ground coal. The calorific content of the final blend slurry was about 7500 btu/lb. It was a poor quality slurry and the Stormer viscosity was about 300–400 centipoise. Additional ammonium lignosulfonate did not improve the viscosity.

EXAMPLE 4

It was unexpectedly found that a stable pumpable final blend slurry comprising 10 wt. % of whole waste aqueous slurry and 90 wt. % of Pittsburgh No. 8 aqueous coal slurry was produced by mixing a first portion of ammonium lignosulfonate with the whole waste aqueous slurry of Example 1 and a second portion of ammonium lignosulfonate with the Pittsburgh No. 8 aqueous coal slurry prior to mixing said whole waste slurry with said coal slurry. It was necessary to have adequate dispersant to prevent solidification. However, to control stability, overdosage of the additive had to be avoided. The maximum desirable total dosage of additive was 0.14 wt. % (basis wt. of final blend slurry). For example, ammonium lignosulfonate was mixed with the whole waste aqueous slurry comprising 33.6 wt. % solids in the amount of about 0.5 wt. % of the whole waste slurry in the final blend. Additional ammonium lignosulfonate was mixed with the coal slurry, having a solids content of 65.5 wt. %, in the amount of about 0.1 wt. % of the Pittsburgh No. 8 aqueous coal slurry in the final blend. The stable final blend pumpable slurry had the following characteristics: solids content 62.2 wt. %, calorific heat value 8800 btu/lb, Stormer viscosity 420 centipoise, and ash content 8.21 wt. % (dry wt.).

EXAMPLE 5

This example is similar to Example 4, but a stable final blend slurry is produced that comprised 20 wt. % of whole waste aqueous slurry and 80 wt. % of Pittsburgh No. 8 coal aqueous slurry. The final blend slurry was produced by mixing a first portion of ammonium lignosulfonate with the whole waste aqueous slurry (see Example 1) and a second portion of ammonium lignosulfonate separately with the aqueous slurry of Pittsburgh No. 8 coal prior to mixing said whole waste aqueous slurry with said Pittsburgh No. 8 coal aqueous slurry.

The whole waste aqueous slurry in the final blend comprised 33.6 wt. % solids plus oil and 66.4 wt. % of water. The calorific heat content was 4,540 btu/lb. Prior to mixing, the whole waste aqueous slurry contained 0.5 wt. of ammonium lignosulfonate (basis wt. % of whole waste aqueous slurry).

The Pittsburgh No. 8 coal aqueous slurry had a solids content of 70.0 wt. % and a Stormer viscosity of 938 centipoise. Further, prior to mixing, it contained about 0.1 wt. % (basis wt. of coal slurry) of ammonium lignosulfonate, and had a calorific heat value of about 9870 btu/lb.

The final blend aqueous slurry had a solids content of about 60.9 wt. %, a calorific heat value of 8,800 btu/lb, and a Stormer viscosity of 192 centipoise.

EXAMPLE 6

A pumpable final blend aqueous slurry comprising 10 wt. % of whole waste aqueous slurry and 90 wt. % of an aqueous slurry of petroleum coke was produced by mixing a first portion of ammonium lignosulfonate with the whole waste aqueous slurry and a second portion of ammonium lignosulfonate separately with the aqueous slurry of petroleum coke, prior to mixing with moderate stirring said whole waste slurry with said petroleum coke slurry. The whole waste aqueous slurry had a oil-solids content of 33.6 wt. % and the remainder i.e. 66.4 wt. % was water. Ammonium lignosulfonate was present in the amount of 0.5 wt. % of the whole waste aqueous slurry. The aqueous slurry of petroleum coke had a solids content of 66.2 wt. %, and a Stormer viscosity of about 927 centipoise. Further, it contained about 0.1 wt. % of ammonium lignosulfonate (basis wt. of petroleum coke slurry). The total amount of ammonium lignosulfonate in the final blend aqueous slurry was about 0.14 wt % (basis wt. of final blend slurry).

The pumpable final blend aqueous slurry had a solids content of 61.9 wt. % and a calorific heat value of about 9500 btu/lb. The Stormer viscosity was about 350 centipoise. Stability of the final blend slurry was satisfactory.

Various modifications of the invention as hereinbefore set forth may be made without departing from the spirit and scope thereof, and therefore, only such limitations should be made as are indicated in the appended claims.

I claim:

1. A partial oxidation process comprising:

(1) mixing together low heating value liquid hydrocarbonaceous and/or solid carbonaceous hazardous waste materials from the production, refining and marketing of petroleum products with additional water when needed and about 0.3 to 2.0 wt. % of an anionic surface active agent to produce a stable pumpable aqueous mixture having a solids content in the range of up to about 70 wt. %;

(2) mixing together a solid carbonaceous fuel selected from the group consisting of coal, petroleum coke, asphalt, tar sands, and mixtures thereof with water and from about 0.02 to 1.00 wt. % of an anionic surface active agent to produce a stable pumpable aqueous slurry having a solids content in the range of about 50 to 70 wt. %;

(3) mixing together from about 4 to 19 parts by weight of the mixture from (2) per part by weight of the mixture from (1) to provide a stable pumpable final blend aqueous slurry having a solids content in the range of about 50 to 70 wt. %; and (4) reacting the final blend aqueous slurry from (3) in a free-flow unobstructed refractory lined partial oxidation reaction zone with a free-oxygen containing gas in a reducing atmosphere at a temperature in the range of about 1900° to 3000° F. and a pressure in the range of about 2 to 250 atmosphere to produce a hot raw effluent gas stream comprising $H_2+CO$.

2. The process of claim 1 wherein said solid carbonaceous fuel in step (2), and said solid carbonaceous waste material in (1) have a particle size such that substantially all of said material passes through a sieve in the range of ASTM E-11-87 Standard Sieve Designation Standard 1.40 mm (Alternative No. 14) and at least 80% passes through an ASTM E 11-87 Sieve Designation Standard 425 μm (Alternative No. 40).

3. The process of claim 1 wherein said surface active agent is steps (1) and (2) is a calcium, sodium, or ammonium salt of an organic sulfonic acid.

4. The process of claim 3 wherein said surface active agent is 2, 6-dihydroxynaphthalene sulfonic acid.

5. The process of claim 3 wherein said surface active agent is ammonium lignin sulfonate.

6. The process of claim 1 wherein the heating value of the mixture from (1) is less than the heating value of the mixture from (2).

7. The process of claim 1 wherein the heat content of the pumpable aqueous mixture from (1) is up to about 5000 btu per lb.

8. The process of claim 1 wherein the heat content of the pumpable stable aqueous slurry from (2) is about 5000 btu/lb and above.

9. The process of claim 1 wherein the heat content of the final blend aqueous slurry from (3) is above about 5000 btu/lb.

10. The process of claim 1 wherein the stable final blend aqueous slurry from step (3) has a viscosity in the range of about 100 to 1000 centipoise as determined by a Stormer viscosimeter.

11. The process of claim wherein the coal in (2) is selected from the group consisting of anthracite, bituminous, sub-bituminous, lignite, and mixtures thereof.

* * * * *